US007191495B2

(12) United States Patent
Panizza

(10) Patent No.: US 7,191,495 B2
(45) Date of Patent: Mar. 20, 2007

(54) DEVICE FOR FASTENING, QUICK UNFASTENING, SAFETY RELEASE AND ADJUSTMENT OF STRAPS FOR WALKING STICKS, SKI POLES, HIKING CANES AND THE LIKE

(75) Inventor: Paolo Panizza, Bassano del Grappa (IT)

(73) Assignee: Gabel S.r.l., Tezze Sul Brenta (IT)

( * ) Notice: Subject to any disclaimer, the term of this patent is extended or adjusted under 35 U.S.C. 154(b) by 185 days.

(21) Appl. No.: 10/870,077

(22) Filed: Jun. 17, 2004

(65) Prior Publication Data

US 2005/0005404 A1 Jan. 13, 2005

(30) Foreign Application Priority Data

Jun. 27, 2003 (IT) ..... VI2003A0123

(51) Int. Cl.
*A44B 11/00* (2006.01)

(52) U.S. Cl. ..... 16/436; 16/422; 16/426; 24/130; 24/265 R; 24/265 EC; 24/265 BC

(58) Field of Classification Search ..... 16/422, 16/426, 428, 436, 444, DIG. 24, DIG. 25; 24/265 R, 130, 265 EC, 265 C, 265 BC; 280/819, 821, 822
See application file for complete search history.

(56) References Cited

U.S. PATENT DOCUMENTS

| | | | | |
|---|---|---|---|---|
| 3,658,356 | A * | 4/1972 | Van Reyper | 280/822 |
| 3,982,747 | A * | 9/1976 | Schweinsberg | 280/822 |
| 4,288,100 | A | 9/1981 | Aho | |
| 4,288,101 | A | 9/1981 | Aho | |
| 5,328,205 | A | 7/1994 | Bacharach | |
| 5,443,287 | A | 8/1995 | Wells | |
| 5,470,108 | A * | 11/1995 | Goode et al. | 280/823 |
| 5,758,388 | A * | 6/1998 | Bjerke | 16/110.1 |
| 6,139,060 | A * | 10/2000 | Lenhart | 280/821 |
| 6,311,370 | B1 * | 11/2001 | Blin | 16/436 |
| 6,851,437 | B1 * | 2/2005 | Lenhart | 135/72 |
| 2002/0067036 | A1 * | 6/2002 | Young et al. | 280/819 |
| 2003/0042726 | A1 * | 3/2003 | Wang | 280/821 |

FOREIGN PATENT DOCUMENTS

| | | | |
|---|---|---|---|
| CH | 631082 | A5 * | 7/1982 |
| DE | 41 03 235 | | 8/1992 |
| DE | 42 35 153 | | 4/1994 |
| DE | 196 36 852 | | 2/1998 |
| EP | 0 958 009 | | 11/1996 |
| EP | 0 919 147 | | 6/1999 |
| EP | 1 036 579 | | 9/2000 |
| FR | 2584612 | A1 * | 1/1987 |
| FR | 2 792 539 | | 10/2000 |
| IT | VI2001A000207 | | 12/2001 |

* cited by examiner

*Primary Examiner*—Chuck Y. Mah
*Assistant Examiner*—Michael J. Kyle
(74) *Attorney, Agent, or Firm*—Bucknam and Archer

(57) ABSTRACT

A device is provided for the fastening, quick unfastening, safety release and adjustment of straps for the handles of walking sticks, ski poles, hiking canes and the like. The device includes a buckle (2), on which are wound the strap (3) and a wedge (4), firmly fixed, in an integral manner, near to one of the two end portions (6) of the strap. The device is characterized by the special configuration of the buckle (2), as well as of the quick unfastening and safety features.

2 Claims, 5 Drawing Sheets

DEVICE FOR FASTENING, QUICK UNFASTENING, SAFETY RELEASE AND ADJUSTMENT OF STRAPS FOR WALKING STICKS, SKI POLES, HIKING CANES AND THE LIKE

FIELD OF THE INVENTION

The present invention relates to a device for the fastening, quick unfastening, safety release and adjustment of straps for the handles of walking sticks, ski poles, hiking canes and the like.

BACKGROUND OF THE INVENTION

As is well known, walking sticks, hiking canes and ski poles are equipped with a strap fixed to the grip which, in typical use, wraps around the wrist of the hand gripping the implement, in such a way as to alleviate the user from the effort of gripping tightly and supporting the implement itself. The strap is usually fixed to the handle by means of a screw, whereas to close it and adjust its size a buckle or the combination of a buckle with a VELCRO® or hook and loop fastener is used. Such a provision, against the technical simplicity of construction, has the drawback of creating difficulties for the user during size adjustment and the quick fastening/unfastening of the strap.

In the present state of the art, strap fastening and adjustment devices are known which foresee different types of constructive solutions, such as the use of buckles that are integral or integrated with the body of the handle, with or without quick fasteners, with or without the possibility of adjustment of the length of the strap or capable of being locked by clamps or wedges. For examples of such devices, the following patent documents are noted: EP-A-0,0919, 147, EP-A-01,036,579, U.S. Pat. No. 5,443,287, DE-A-19636852, EP-A-0958009, U.S. Pat. No. 4,288,100, DE-A-4103235, U.S. Pat. No. 4,288,101, FR-A-2792539, U.S. Pat. No. 5,328,205, DE-A-4235153, which describe fastening systems that require a certain complexity of realization of the handles, since inside the handles adjustment and attachment mechanisms are integrated, or else they do not realize quick unfastening.

In Italian patent application No. VI2001A000207 filed on Dec. 4, 2001 by the Applicant herein, the realization of a fastening and adjustment device of a strap is described. The device is characterized in that it comprises a buckle on which the strap is wound and a wedge applied to the end of the strap. The buckle has a flexible base, equipped at the bottom with a tooth, which is inserted into a corresponding notch on the seat, formed on the body of the handle, intended to receive the device when it is in fastening mode. Such a device, while constituting an innovative solution with respect to similar known products, has the drawback that fastening is ensured by the thrusting action of the wedge against the walls of the seat itself and therefore, in unfastening, where it is necessary to slightly withdraw the wedge, the "adjustment" of the strap is lost. Also, a safety unfastening system is not provided.

SUMMARY OF THE INVENTION

The object of the present invention is to provide a device for the fastening, quick unfastening, safety release and adjustment of the strap for handles of walking sticks, ski poles, hiking canes and the like which, while being constructively similar to the one described above, does not have its drawbacks.

The above object is accomplished in accordance with the present invention by the provision of such a device having a buckle on which is wound a strap, and a wedge, firmly fixed in an integral manner, with an upper surface, near to one of the two end portions of the strap, the wedge engaging with a lowered secure surface thereof on another end portion of the strap. The buckle comprises a U-shaped boxed body containing a through-piece and a base which connect to shoulders of the boxed body, the base having a projecting tooth and each shoulder having a flexible tab at the top. The body is inserted exactly inside a seat formed in the pole handle, the firm attachment of the buckle in the handle seat being ensured by the insertion of the tooth in a notch formed in the seat, the tooth being kept in position by the contrasting thrusting action against the top of the seat, of the flexible tabs, which are preloaded due to elastic compression deformation undergone during insertion of the buckle in the seat.

BRIEF DESCRIPTION OF THE DRAWINGS

The invention will be better understood through the description of a possible embodiment thereof, given only as an illustrative and non-limiting example, with the help of the attached drawings, in which.

DETAILED DESCRIPTION OF THE INVENTION

Figure 1:
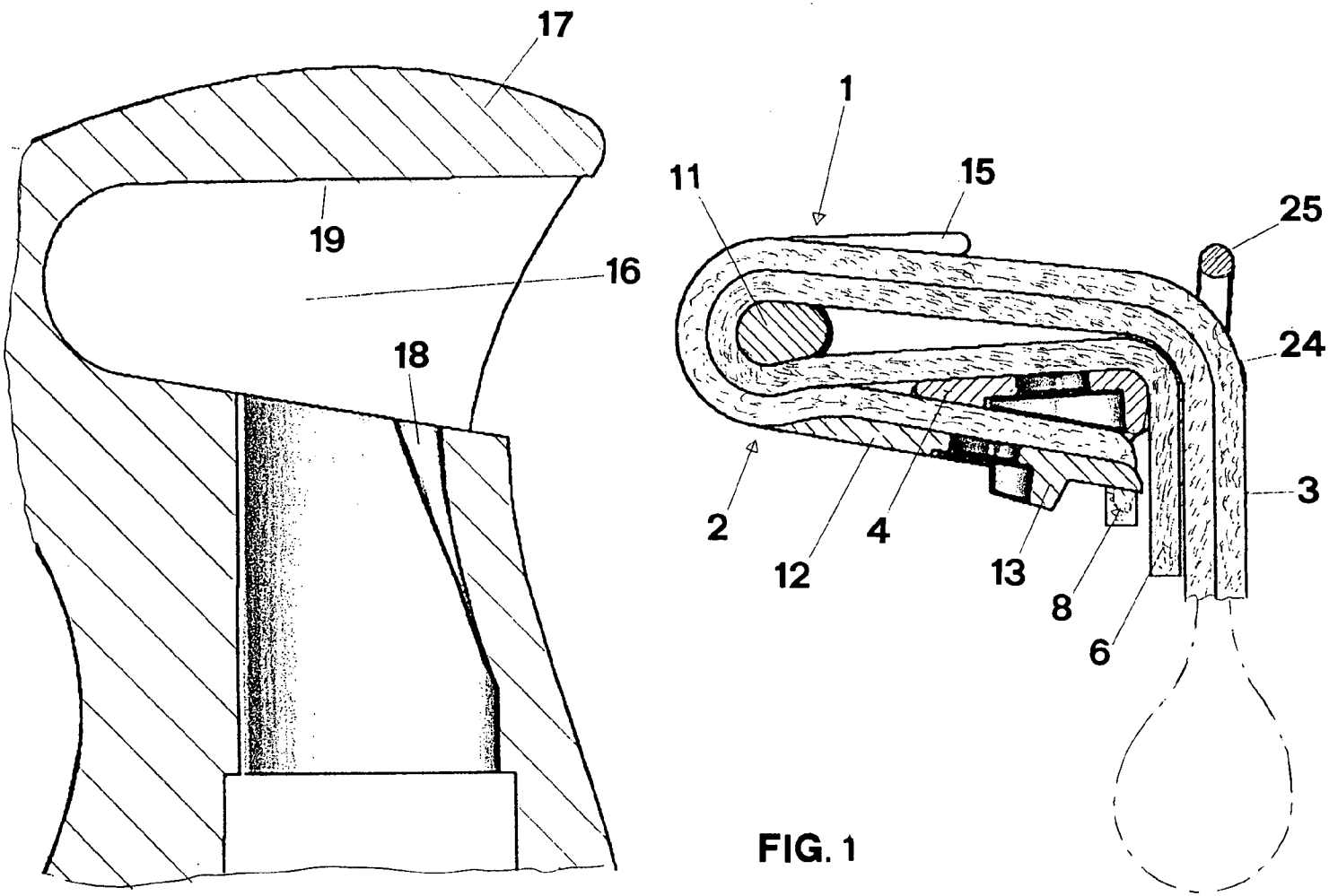
FIG. 1 is a front elevational, cross-sectional view of the device according to the present invention.
Figure 2:
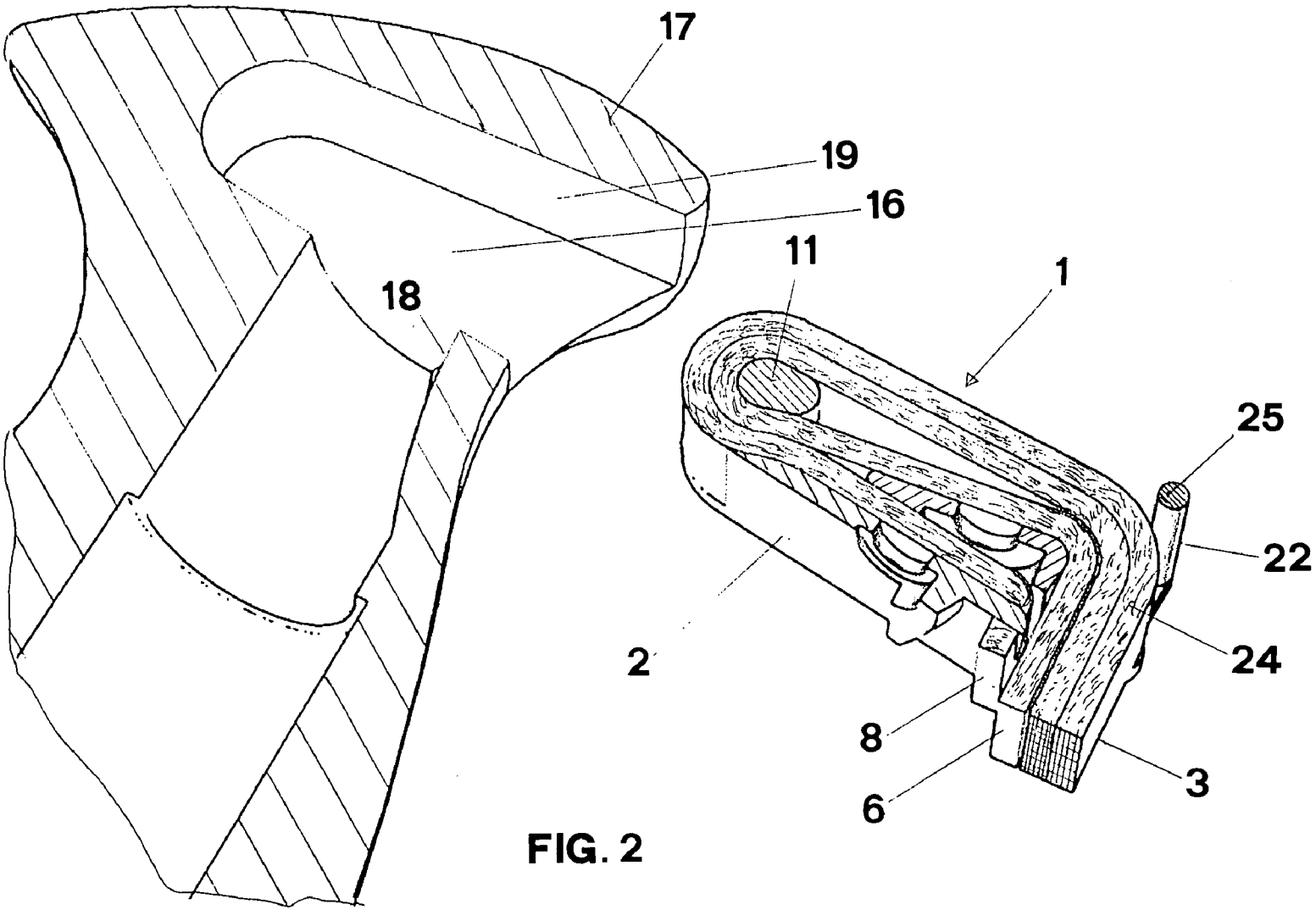
FIG. 2 is a perspective view of the deice as shown in FIG. 1.
Figure 3:
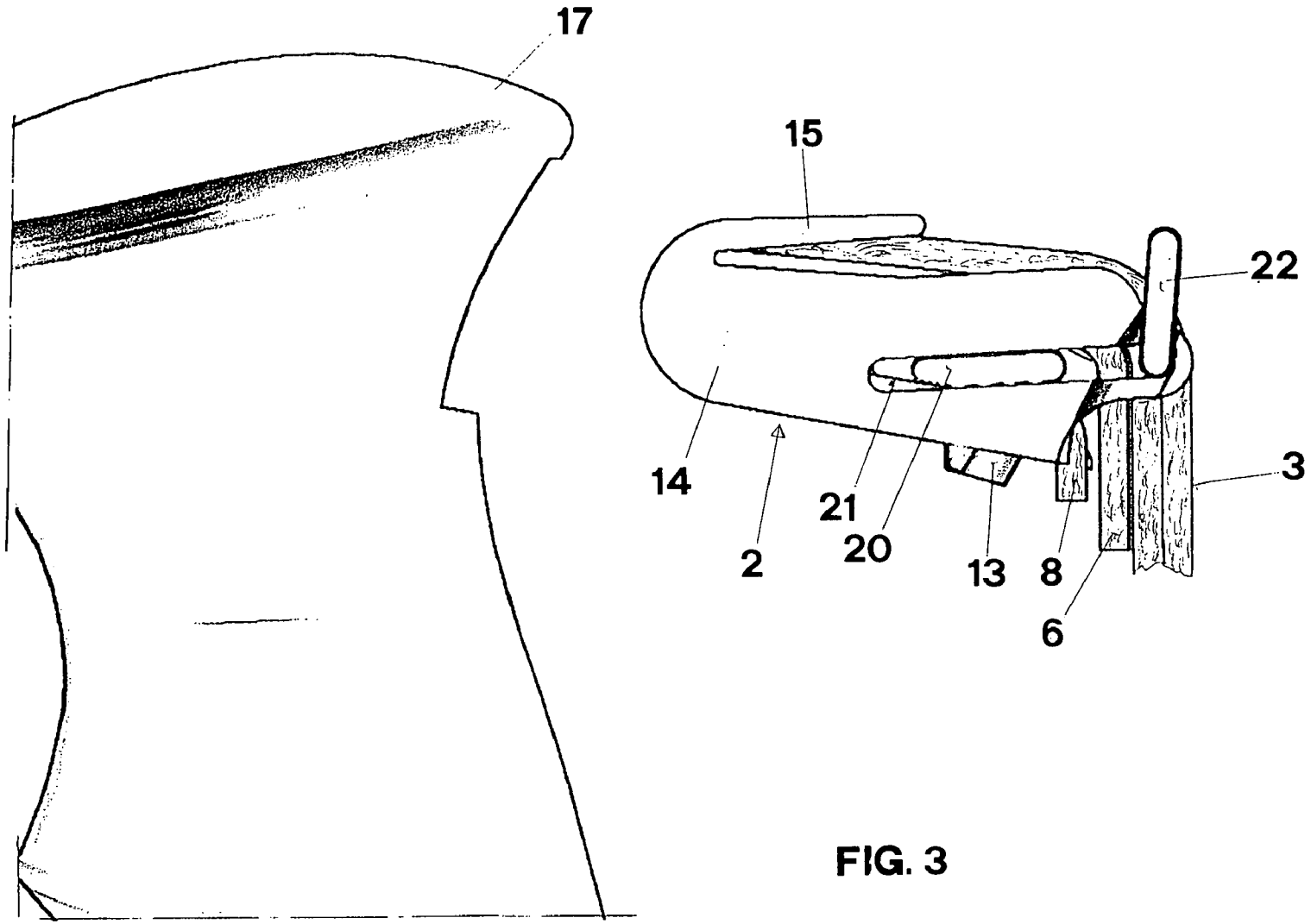
FIG. 3 is an outer front elevational view of the device according to FIG. 1.
Figure 4:
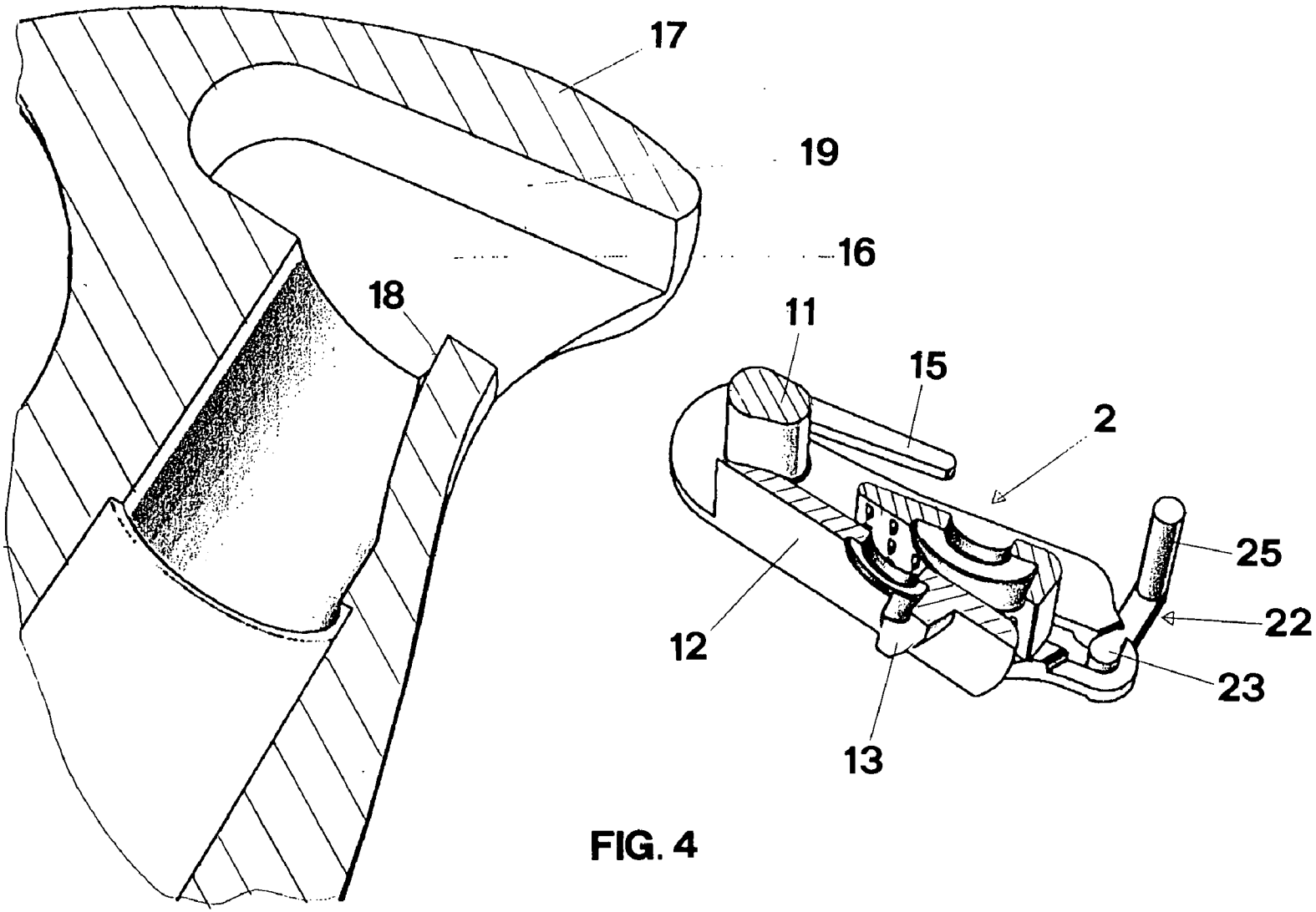
FIG. 4 is a perspective view of the device as shown in FIG. 2, without the strap.
Figure 5:
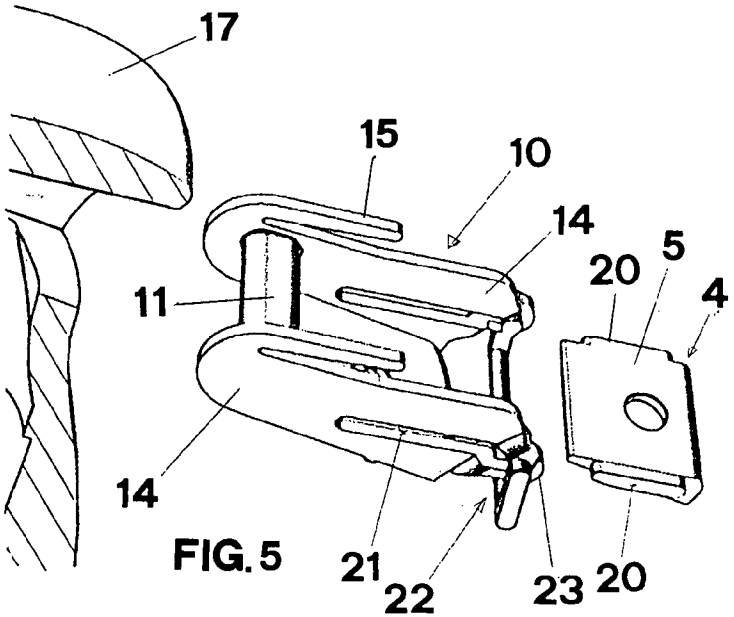
FIGS. 5 and 6 show respective upper and lower exploded perspective views of the device according to the present invention, without the strap.
Figure 6:
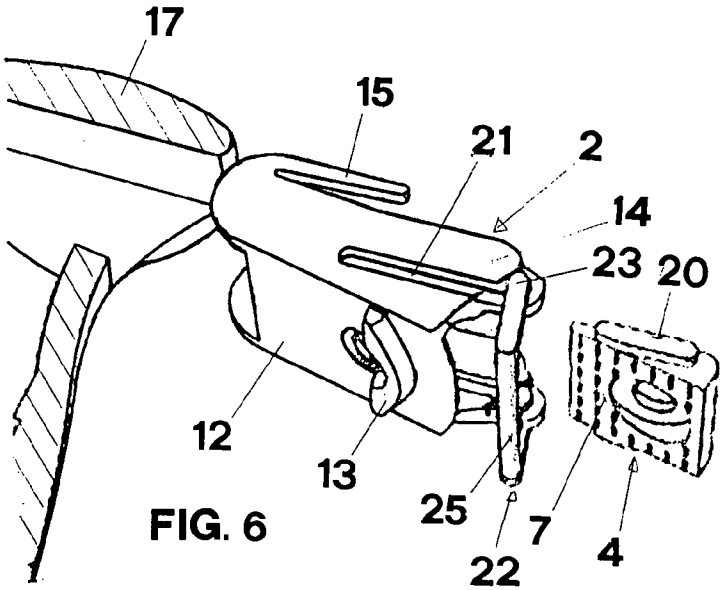
Figure 7:
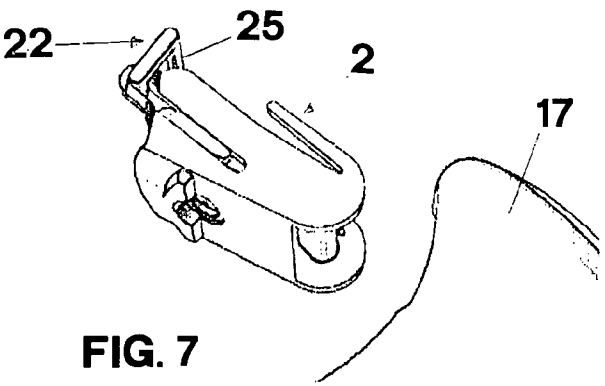
FIGS. 7 and 8 show outer perspective views of the device according to the present invention, without the strap and with the safety unfastening system in work and rest position, respectively.

As can be seen in FIG. 1, the strap fastening, unfastening and adjustment device, generally indicated with reference numeral 1, comprises a buckle 2 on which the strap 3 is wound and a wedge 4, firmly attached in an integral manner with its upper surface 5 (see FIG. 5), near to one of the two end portions 6 of the strap itself and which engages, with its lower secured surface 7 (see FIG. 6), in a removable manner, on the other end portion 8 of said strap.

A first novel characteristic of the invention concerns the buckle 2, consisting of a U-shaped boxed body 10 containing the through-piece 11 and that comprises a base 12, equipped at the bottom with a projecting tooth 13, which connects to the shoulders 14, equipped at the top with flexible tabs 15. Said body inserts exactly inside a corresponding seat 16, formed on the handle 17 of a walking stick, etc.

The firm attachment of the buckle 2 to the handle 17 is ensured by the tooth 13 that inserts into the corresponding notch 18, present in the seat 16. Said tooth is kept in position by the contrasting thrusting action against the top 19 of seat 16 of the flexible tabs 15, which are preloaded due to the elastic compression deformation that they have undergone during the insertion step of the buckle in the seat itself.

A second novel characteristic of the invention concerns the locking system of wedge 4, for fixing and maintaining the adjustment of the length of the strap defined by the user, which is advantageously realized through a fastening of the aforementioned wedge to the body of buckle 2 and therefore without interacting with the walls of the containment seat 16. Such fastening is realized between the keys 20, projecting laterally from the wedge 4, which engage to slide in the corresponding slits 21, formed on the shoulders 14 of the buckle 2.

In operation, with the adjustment of the length of the strap by the user, which occurs with a process common to all devices based upon the use of the so-called "wedge-lock," the wedge 4 is pulled towards the inside but, thanks to their configuration, its side keys 20 slot into the corresponding slits 21 of buckle 2, thus determining the desired locking of the wedge itself inside the buckle 2. During use, the assembly scheme ensures positive retro-action between the traction of the wrist on the strap and the holding thrust of the wedge, which thus stably and "automatically" locks the strap and the buckle itself.

With such a constructive solution the unfastening of the buckle is simple and quick with respect to the analogous operation carried out manually by the user who, using both hands, had to first of all withdraw the wedge from the seat and then lift the portion of the buckle projecting from the handle to free said buckle from the clamping seat.

Vice-versa, with the quick unfastening system according to the invention, the user must simply grip the end portion 6 or both of the end portions 6 and 8 of the strap with the fingers of his/her hand and pull upwards, possibly making a pivot with the thumb on the top of the handle, to manage to lift the base 12, overcoming the reaction of the flexible tabs 15, to such an extent as is necessary to free the tooth 13 from the notch 18.

A third novel characteristic of the invention concerns a safety unfastening system, which automatically realizes the detachment of the strap from the handle in the presence of anomalous movements or violent strains on the stick or pole. Constructively, such a quick unfastening system comprises a through-piece 22 with a lever, pivoted with its base 23 on the most outer part of the buckle 2, so as to be able to be positioned by the user above the portion of strap 24 (see FIGS. 1–4 and 7), when it must be active or else, vice-versa, to be arranged below said portion (see FIG. 8) or become detached when it is not used.

When the through-piece 22 is in operating position, in the case of an anomalous traction associated with a substantial upward angular displacement of the strap as a consequence, for example, of the user falling down, the portion 24 of the strap acts upon the pin 25 of said through-piece, lifting it, for which reason, consequently, the lifting of the base 12 of the buckle and therefore the unfastening of the buckle is realized, automatically freeing the hand with the strap from the handle and from the entire stick or pole.

Figure 8:
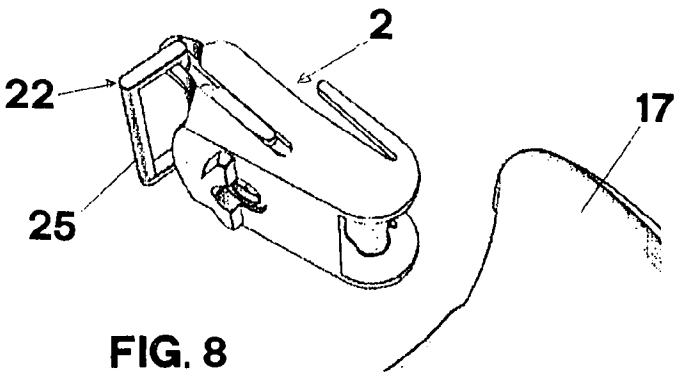

Again operatively, when the user does not want such safety unfastening, he/she must just detach the pin 25 from the buckle and, possibly, rearrange it so that it is positioned below the strap 3 as in FIG. 8.

Of course, embodiments both of the buckle and of the wedge different to those described are also possible, without affecting the constructive and operating characteristics defined by the following claims.

What is claimed is:

1. Device for fastening, quick unfastening, safety release and adjustment of straps for walking sticks, ski poles, hiking canes, comprising a buckle (2), on which is wound a strap (3), and a wedge (4) firmly fixed, in an integrated manner, with an upper surface (5) of said wedge near to a first end portion (6) of said strap, a lower secured surface (7) of said wedge engaging in a removable manner, on a second end portion (8) of said strap, said device being characterized in that:

said buckle (2) comprises a U-shaped boxed body (10) having a through-piece (11) and a base (12), which connect to shoulders (14) of said body (10), said base (12) being equipped with a projecting tooth (13); each of said shoulders being equipped at the top with a flexible tab (15); said body being adapted to be inserted exactly inside a corresponding seat (16) formed on a handle (17) of a walking stick, ski pole, hiking cane, the firm attachment of the buckle (2) to the handle (17) being insured by the tooth (13) being adapted for insertion into a corresponding notch (18) located in the seat (16) of handle (17), said tooth being kept in position by the contrasting thrusting action against a top (19) of said seat of the flexible tabs (15), which are preloaded due to elastic compression deformation that they have undergone during insertion of the buckle in the seat of the handle;

said device further comprises a pair of keys (20) projecting laterally from said wedge, said keys being slidably engaged in corresponding slits (21) formed on the shoulders (14) of the buckle, said keys having a configuration whereby when the wedge is pulled inwards the keys (20) slot into the corresponding slits (21) ensuring locking of the wedge (4) to fix and maintain the length adjustment of the strap.

2. Device for fastening, quick unfastening, safety release and adjustment of straps for walking sticks, ski poles, hiking canes, comprising a buckle (2), on which is wound a strap (3), and a wedge (4) firmly fixed, in an integrated manner, with an upper surface (5) of said wedge near to a first end portion (6) of said strap, a lower secured surface (7) of said wedge engaging in a removable manner, on a second end portion (8) of said strap, said device being characterized in that:

said buckle (2) comprises a U-shaped boxed body (10) having a through-piece (11) and a base (12), which connect to shoulders (14) of said body (10), said base (12) being equipped with a projecting tooth (13); each of said shoulders being equipped at the top with a flexible tab (15); said body being adapted to be inserted exactly inside a corresponding seat (16) formed on a handle (17) of a walking stick, ski pole, hiking cane, the firm attachment of the buckle (2) to the handle (17) being insured by the tooth (13) being adapted for insertion into a corresponding notch (18) located in the seat (16) of handle (17), said tooth being kept in position by the contrasting thrusting action against a top (19) of said seat of the flexible tabs (15), which are preloaded due to elastic compression deformation that they have undergone during insertion of the buckle in the seat of the handle;

said device further comprises a through-piece lever (22) pivoted with its base (23) at the outermost part of said buckle (2), so as to be positionable during operation above a portion (24) of said strap (3) exiting said buckle (2), whereby during an anomalous traction associated with a substantial upward angular displacement of the strap, the portion (24) of the strap acts on a pin (25) of said through-piece lever to lift it and thereby lift the base (12) of the buckle against the reaction of the flexible tabs (15) to the extent necessary to free the tooth (13) from the notch (18) and allow the automatic unfastening of the buckle from the handle.

* * * * *